United States Patent [19]

Ida et al.

[11] Patent Number: 4,614,079

[45] Date of Patent: Sep. 30, 1986

[54] AUTOMATIC PACKAGING SYSTEM

[75] Inventors: Keizo Ida; Akihiko Goto, both of Tokyo, Japan

[73] Assignees: Toppan Printing Co., Ltd.; Kawashima Packaging Machinery Ltd., both of Japan

[21] Appl. No.: 634,628

[22] Filed: Jul. 26, 1984

[30] Foreign Application Priority Data

| | | | |
|---|---|---|---|
| Mar. 30, 1984 | [JP] | Japan | 59-62533 |
| Mar. 30, 1984 | [JP] | Japan | 59-62534 |
| Mar. 30, 1984 | [JP] | Japan | 59-62535 |
| Mar. 30, 1984 | [JP] | Japan | 59-62536 |
| Mar. 30, 1984 | [JP] | Japan | 59-62537 |
| Mar. 30, 1984 | [JP] | Japan | 59-62538 |

[51] Int. Cl.[4] ..... B65B 43/34

[52] U.S. Cl. ..... 53/563; 53/379; 53/388; 53/576; 53/579

[58] Field of Search ..... 53/127, 375, 379, 388, 53/440, 562, 563, 564, 568, 579, 576; 198/654; 426/392, 399, 407, 410

[56] References Cited

U.S. PATENT DOCUMENTS

| | | | |
|---|---|---|---|
| 689,474 | 12/1901 | Fales | 53/526 |
| 1,213,265 | 1/1917 | Rowe | 198/487 |
| 2,446,798 | 8/1948 | Vergobbi | 53/563 |
| 3,507,095 | 4/1970 | Kuhnle | 53/563 |
| 3,568,816 | 3/1971 | Smith | 198/654 |
| 4,120,984 | 10/1978 | Richardson et al. | 53/440 |
| 4,437,315 | 3/1984 | Rica et al. | 53/440 |
| 4,458,469 | 7/1984 | Dunn | 53/440 |
| 4,509,312 | 4/1985 | Nakajima | 53/375 |

FOREIGN PATENT DOCUMENTS

| | | | |
|---|---|---|---|
| 1134446 | 4/1957 | France | 53/563 |

*Primary Examiner*—John Sipos
*Assistant Examiner*—Donald R. Studebaker
*Attorney, Agent, or Firm*—Bacon & Thomas

[57] ABSTRACT

An automatic packaging system comprising a container fabricating mechanism for forming a tubular structure from laminated paper capable of heat sealing, marking folding guidelines for forming rectangular-prism-shaped containers, cutting individual pouched containers from the tubular structure, and shaping one end of each pouched container, and a packaging mechanism for filling the shaped containers with a filling material and sealing the openings of the containers. The container fabricating mechanism includes a rotating mandrel mechanism formed of a plurality of radially arranged pairs of forming plates to receive the cut pouched containers. The packaging mechanism includes an endless conveyor mechanism for feeding the containers processed by the container fabricating mechanism, and a deflating mechanism for removing air from the top inside spaces of the containers filled with the filling material, a lug folding/heat-sealing mechanism for heat-sealing the openings of the containers immediately after deflation and then folding and heat-sealing the heat-sealed portions flat.

5 Claims, 23 Drawing Figures

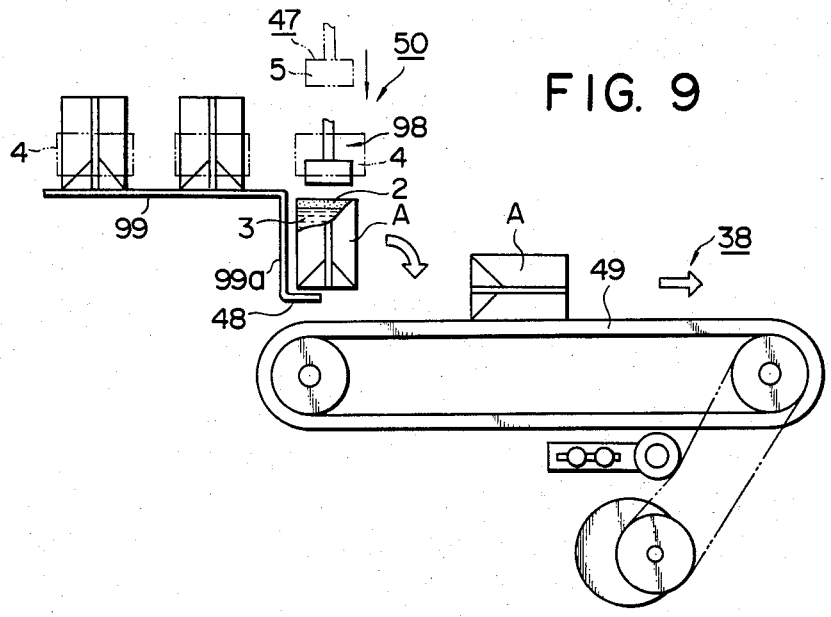
FIG. 9
FIG. 10
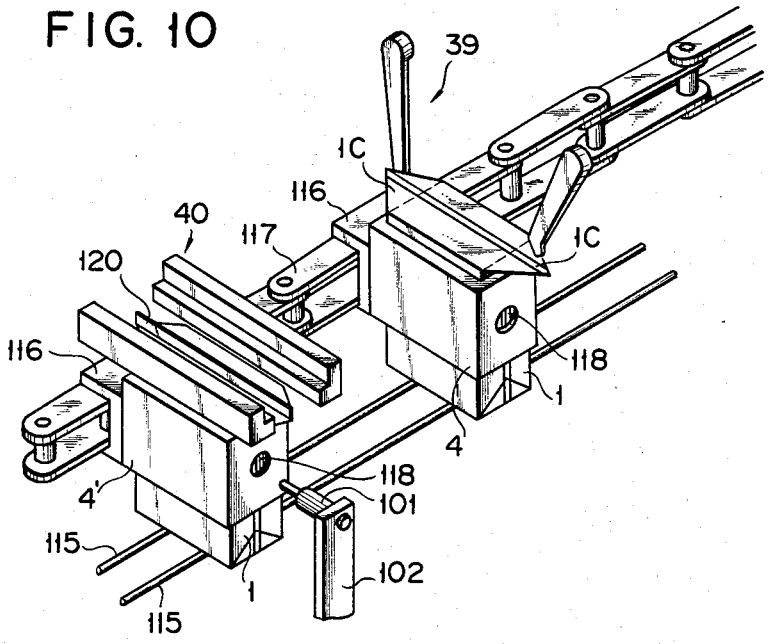

AUTOMATIC PACKAGING SYSTEM

BACKGROUND OF THE INVENTION (a) Field of the Invention

The present invention relates to an automatic packaging system capable of performing, in an integrated process, fabrication, filling and sealing of rectangular-prism-shaped (or rectangular parallelepiped) packaging containers for packaging a liquid, such as juice, liquor, milk, etc.

(b) Description of the Prior Art

An automatic packaging system has recently been developed which fabricates bottomed, hollow rectangular-prism-shaped containers from laminated paper with thermoplastic films, such as polyethylene, on both sides thereof, fills the containers with a filling material, and then seals the openings of the containers to complete packaged products. In the prior art automatic packaging system, however, a mechanism for forming a tubular structure from a laminated sheet coated with polyethylene or other heat-sealing material, cutting the tubular structure into containers of a suitable size, and delivering the containers to a rectangular container end processing mechanism may damage the container material due to its imperfect function. Also, a forming unit of the container end processing mechanism may produce defective products, or a conveyor mechanism for formed containers may be complicated in structure. In heat-sealing the openings of the rectangular containers after filling the containers with contents, moreover, excessive air may remain in the top inside spaces of the containers to bulge the trunk portions thereof, complicating the removal of the containers from the conveyor mechanism and lowering the commercial value of the products. According to the conventional system, furthermore, the rectangular containers may be deformed when triangular lugs produced by heat-sealing the openings of the containers are folded and sealed on the top faces of the containers. If the containers are filled with a heated material, moreover, residual air in the containers will be heated and expanded by the heat of the filling material to bulge the top portions of the sealed containers. Accordingly, the containers will not be able to be smoothly transferred from the conveyor mechanism to another conveyor mechanism.

SUMMARY OF THE INVENTION

The object of the present invention is to provide an automatic packaging system for rectangular-prism-shaped packaging containers obviating the aforementioned drawbacks of the prior art automatic packaging system, which allows smoothing of fabricating, shaping, filling, sealing, and feeding processes for the rectangular-prism-shaped containers, and is free from defective products.

According to the present invention, there is provided an automatic packaging system which comprises a container fabricating mechanism for forming a tubular structure from laminated paper capable of heat sealing, marking folding guidelines for forming rectangular-prism-shaped containers, cutting individual pouched containers from the tubular structure, and shaping one end of each pouched container, and a packaging mechanism for filling the shaped containers with a filling material and sealing the openings of the containers, and is characterized in that the container fabricating mechanism includes a rotating mandrel mechanism formed of a plurality of radially arranged pairs of forming plates to receive the cut pouched containers, whereby one end of each pouched container is processed, and that the packaging mechanism includes an endless conveyor mechanism for feeding the rectangular-prism-shaped containers processed by the container fabricating mechanism while keeping the other end openings of the containers upward, a deflating mechanism for removing air from the top inside spaces of the containers filled with the filling material, a lug folding/heat-sealing mechanism for heat-sealing the openings of the containers immediately after deflation and then folding and heat-sealing the heat-sealed portions flat, and a discharge mechanism for transferring the containers from the conveyor mechanism to another conveyor mechanism.

BRIEF DESCRIPTION OF THE DRAWINGS

FIG. 9 is a side view showing a state of the terminal end side of the conveyor system of FIG. 8;

FIG. 10 is a perspective view of a deflating mechanism according to the one embodiment of the invention;

DETAILED DESCRIPTION OF THE PREFERRED EMBODIMENTS

Preferred embodiments of the present invention will now be described in detail with reference to the accompanying drawings.

Figures 1, 2:
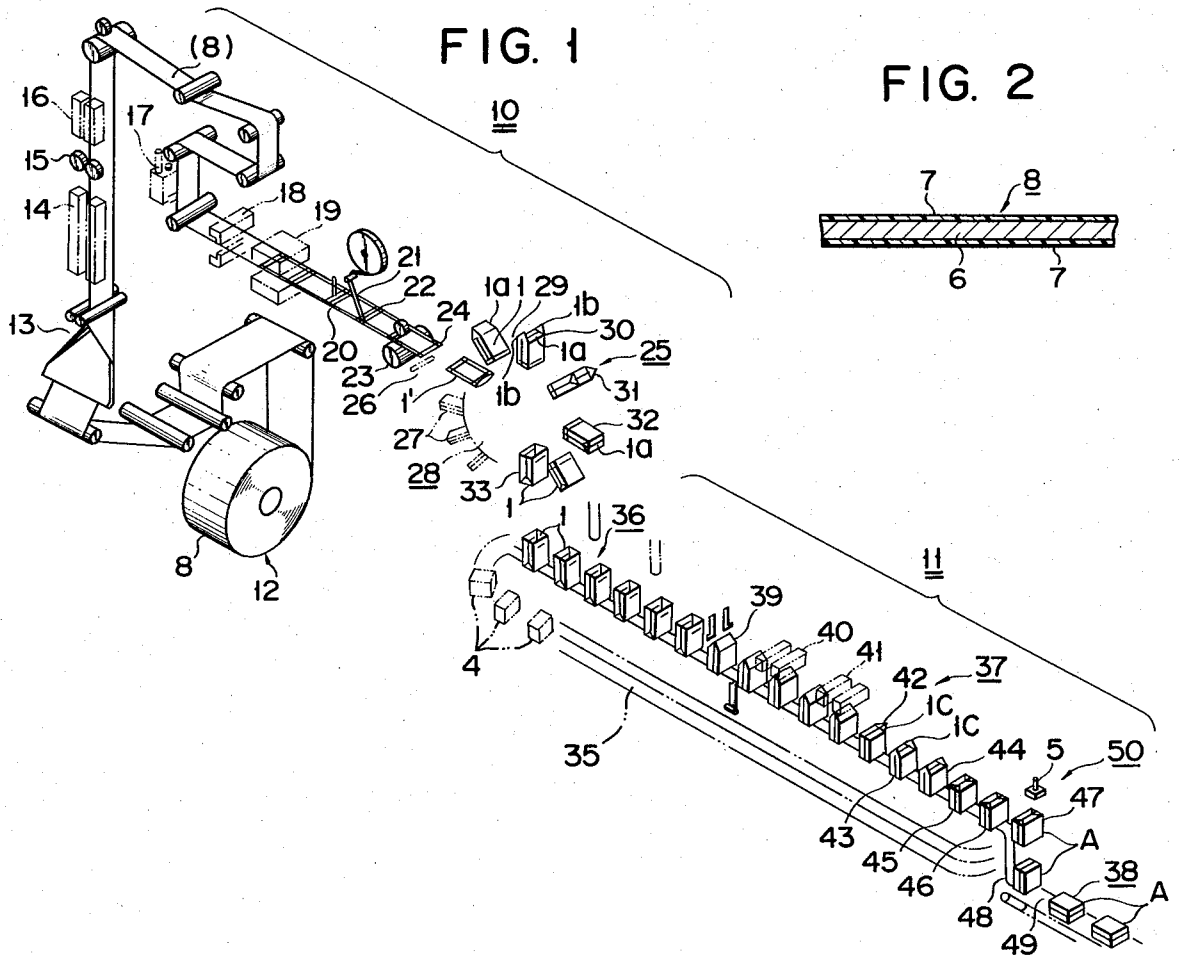
FIG. 1 schematically shows a layout of an automatic packaging system according to one embodiment of the present invention.
FIG. 2 is a sectional view showing an example of a container material used in the invention.

FIG. 1 is a schematic view showing the layout of an automatic packaging system according to one embodiment of the present invention. Roughly speaking, the automatic packaging system is composed of a container fabricating mechanism section 10 for fabricating bottomed, rectangular-prism-shaped containers 1 from a container material 8, and a packaging process section 11 for filling the containers 1 formed by the container fabricating mechanism section 10 with a filling material 3 and sealing the opening of the container 1. As shown in FIG. 2, the container material 8 is a laminated sheet which is formed by coating both sides of a one-sidedly printed paper 6 with thermoplastic films 7 such as polyethylene films.

As shown in FIG. 1, the container fabricating mechanism section 10 includes a container material supply unit 12 for delivering the container material 8, a doubling unit 13 for folding the container material 8 in two along the feeding direction, a side edge sealing unit 14 for heat-sealing the side edge portions of the container material 8 to form tubular structure, and first and second side-edge seal cooling units 15 and 16 for cooling the heat-sealed portions of the container material 8. The second seal cooling unit 16 is followed by a date printing unit 17 for printing the date of manufacture, a top sealing unit 18 for sealing the container material 8 at right angles to the feeding direction thereof at regular intervals so that each individual container 1 has a top seal portion when it is made up into a packaged product A, and a guideline marking unit 19 for marking the container material 8 with folding guidelines along which the container material 8 is folded to be formed into rectangular-prism-shaped structures.

The guideline marking unit 19 is followed by a sipper hole boring unit 20, a tab tape pasting unit 22 for covering a sipper hole with a tab tape 21, an inching unit 23 for inching the container material 8, and a cutting unit 24 for cutting off each individual container in the form of a bottomed flat pouch with an opening forward from the container material 8.

Disposed on the lower-course side of the cutting unit 24 is a container shaping/delivery section 25 where each unshaped container 1' in the form of a bottomed flat pouch cut from the container material 8 is shaped into a bottomed, hollow rectangular prism, and is delivered to the packaging process section 11 in a manner such that the opening of the container faces upward.

The container shaping/delivery section 25 is provided with an unshaped container feeding unit 26 which attracts both top and bottom panels of each unshaped container 1' on the open end side thereof to open the container by means of a pair of suckers and then transfers the unshaped container 1'. The unshaped containers 1' delivered from the unshaped container feeding unit 6 are fitted individually on container holding portions 27 (each formed of a pair of forming plates) of a mandrel unit 28 as container transfer means which are arranged radially. The container shaping/delivery unit 25 is also provided with a rectangular-prism shaping unit 29 which opens the unshaped containers 1' at the stop positions of the individual container holding portions 27, and flattens the top portion **1*a* of the container 1 in the form of the packaged product A, that is, the bottom portion of the container 1 at the time of filling. Further arranged along the rotating direction of the mandrel unit 28 are a lug softening unit 30 for making a pair of lugs 1*b* of the top portion 1*a* bendable so that they are laid on both side panels of the container 1, and a heating unit 31 for blowing heated air against the bonding surfaces of the lugs 1*b* to melt surface film layers thereon. The heating unit 31 is followed by a lug press-sealing unit 32, and a folding guide is interposed between these two units 31 and 32. The folding guide the lugs 1*b* against their corresponding side panels of the container 1. The lug press-sealing unit 32 presses against and bonds the lugs 1*b* to the side panels of the container 1** by fusion.

The lug press-sealing unit 32 is followed by a container scraping unit 33 which scrapes off the shaped container in the form of a bottomed rectangular prism with its opening upward into one of box-shaped carriers 4 of container transfer means 35 in the packaging process section 11 as the mandrel unit 28 rotates intermittently.

In the container fabricating mechanism section 10 constructed in this manner, the bottomed, hollow rectangular-prism-shaped containers 1 are successively fed into the packaging process section 11 with their openings upward after they are subjected to date printing, guideline marking, sipper hole boring, and tab tape pasting.

The packaging process section 11 includes a filling process portion 36 for filling the containers 1 successively fed from the container fabricating mechanism section 10 with filling material (or contents), a sealing process portion 37 for sealing the openings of the containers 1 filled with the filling material at the filling process portion 36, and a release mechanism 50 for discharging the packaged products A into a delivery mechanism 38 at the end of the packaging process.

The sealing process portion 37 includes a straight-line shaping unit 39 for shaping and closing the openings of the filled containers 1 in a straight line, a deflating/sealing unit 40 for heat-sealing the shaped openings of the container 1 in a deflated state, a seal cooling unit 41 for cooling sealed portions, a container top flattening unit 42 for pressing and flattening the top of the containers, and a lug raising unit 43 for setting up lugs **1*c* projected sideways by the flattening process. The lug raising unit 43 is followed by a heating unit 44 for heating the lugs 1*c* for fusion, and a lug folding/fusing unit 45 for welding the lugs 1*c* to the top face of the container 1**.

Thus, the containers 1 supplied from the container fabricating mechanism section 10 and put in the box-shaped carriers 4 finish undergoing the packaging process when they reach the lug folding/fusing unit 45. If the containers 1 are to be filled with heated contents as required, the lug folding/fusing unit 45 is followed by a bulge removing unit 46 for sprinkling cooling water over the top faces of the finished packaged products A to cool residual air 2 in the containers 1 warmed and expanded by the filling material, thereby removing bulges attributed to the residual air 2, and a discharge unit 47 for discharging the packaged products A from the carriers 4.

The packaged products A discharged by the discharge unit 47 are thrown down sidelong by a package throw-down unit 48, and are transferred to a conveyor 49 which constitutes the delivery mechanism 38.

Figure 3:
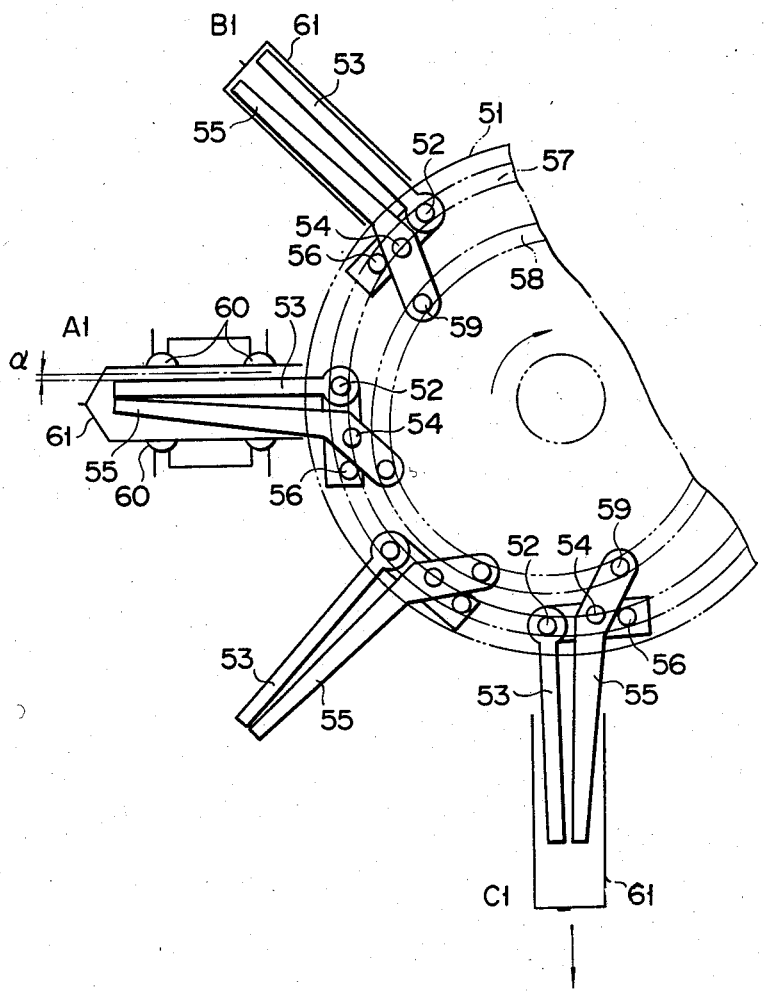
FIG. 3 is a side view showing part of a rotating mandrel supporting forming plates according to the invention.

There will now be described in detail a rotating mandrel mechanism which receives individual pouched containers and processes one end of each container in the container fabricating mechanism of the automatic packaging system of the present invention. FIG. 3 shows the principal part of a rotating mandrel according to the invention. In FIG. 3, a number of pairs of forming plates 53,55 are arranged between a pair of rotating members 51, radially protruding therefrom. Each pair of forming plates include a first forming plate 53 rockable around a shaft 52 and a second forming plate 55 rockable around a shaft 54. A pin 56 protruding from the proximal end portion of the first forming plate 53 is fitted in an eccentric annular groove 57 so that the inclination of the first forming plate 53 can be changed as required as the rotating members 51 rotate. A pin 59 protrudes from the proximal end protion of the second forming plate 55, extending in the same direction as the pin 56. The pin 59 is fitted in an eccentric annular groove 58 so that the inclination of the second forming plate 55 can be changed as required as the rotating members 51 rotate.

The annular grooves 57 and 58 are formed so that when a pair of forming plates 53 and 55 are located in a position A1 where they are inserted in a pouched container 61 opened by suction cups 60, the first forming plate 53 is slightly rocked through an angle $\alpha$ (e.g., about one-fifth of the rocking angle of the second forming plate 55) toward the second forming plate 55, and the distal end of the second forming plate 55 is closely in contact with the firsting forming plate 53. When the first and second forming plates 53 and 55 are in the shaping position (between a position B1 and a discharge position C1), they are kept spread out by the action of the pins 56 and 59. Since the first forming plate 53 in the position A1 is rocked through an angle much narrower than the rocking angle of the second forming plate 55, it is restored more quickly to the original spread state than the second forming plate 55 before reaching the position B1. Therefore, the forming plates 53 and 55 never push back the pouched container as they are spread out.

When the forming plates 53 and 55 are in the position C1 where finished rectangular-prism-shaped containers are discharged, the second forming plate 55 is rotated at least slightly toward the first parallelepiped forming plate 53 so that the rectangular-prism-shaped container 61 can be lowered with ease. After discharging the container 61, the forming plates 53 and 55 are returned to the position A1, and the same operation is repeated. It is also possible to render the first forming plate 53 to slightly rotate toward the second forming plate 55 when the container 61 is discharged.

According to the system of the invention, the forward forming plate (first forming plate) is rocked slightly in the closing direction, so that the opening of each container can be put on the forming plates substantially horizontally. Thus, the container can easily be set without any interference with the forming plates. Moreover, a pair of suction cups 60 on the upper side can be located nearer to the center of the container, so that they are protected against abrasion due to slippage on the container. Furthermore, the container may be prevented from slipping off the forming plates even when the two forming plates are simultaneously spread out for the same angle.

The means for adjusting the inclination of the first and second forming plates is not limited to the aforesaid combination of pin and eccentric groove, and any other suitable conventional means may be used for this purpose.

According to the present invention, moreover, the positions and actions of the suction cups for the delivery of the individually cut pouched structures to the pairs of forming plates 53 and 55 of the rotating mandrel are adjusted in the following manner. This enables the pouched structures to be smoothly delivered to the forming plates.

Figure 4:
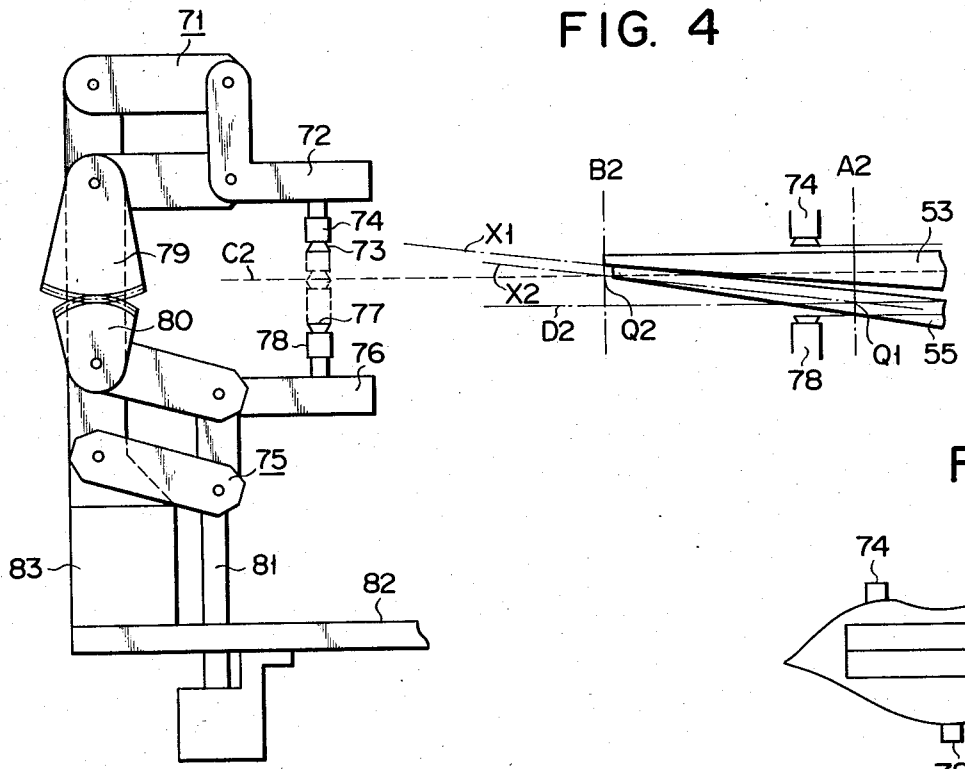
FIG. 4 is a side view showing an outline of a pouched container delivery apparatus according to the one embodiment of the invention.

FIG. 4 schematically shows a construction of a pouched container delivery apparatus according to the invention. In FIG. 4, an upper sucker unit 74 having an upper suction cup 73 facing downward is attached to one block 72 of an upper parallel link 71, while a lower sucker unit 78 having a lower suction cup 77 facing downward is attached to one block 76 of a lower parallel link 75. The upper and lower sucker units 74 and 78 are moved up and down in a proportional manner by the parallel links 71 and 75, respectively, as a pair of mating gears 79 and 80 rotate in mesh with each other. As a result, the opening of a pouched container (not shown) sucked and held by the upper and lower suction cups 73 and 77 is extended vertically. In FIG. 4, a position $C_2$ is the position where the pouched container is held by suction before the sucker units 74 and 78 move up and down. The rotation of the gears 79 and 80 is caused by the vertical drive of a driving shaft 81. The foregoing components are all set on or over a frame 82, which is horizontally moved toward the mandrel by a drive unit 83.

In setting the pouched container on the forming plates 53 and 55 of the mandrel by using the apparatus constructed in this manner, the sucker units 74 and 78 are first moved up and down, respectively, to extend the opening of the container as the mandrel rotates. Then, as the mandrel stops, the frame 82 moves horizontally toward the mandrel, so that the pouched container with the extended opening is put on the forming plates 53 and 55 of the mandrel. The setting course of the pouched container is indicated by a line $C_2$ which is parallel to the horizontal centerline $D_2$ of the mandrel. A line X1 is a conventional ideal setting line having an inclination half the rocking angle $\theta 1$ of the lower (movable) forming plate 55. Thus, since the setting course of the pouched container is parallel to the horizontal centerline $D_2$ of the mandrel, the container can smoothly be set on the forming plates without the difficulties in the operation of the conventional system.

Various tests were conducted to determine a setting line $C_2$ for the smoothest setting of the pouched container. As a result, this setting line $C_2$ proved to be a straight line parallel to the horizontal centerline $D_2$ of the mandrel and passing through the intersection Q2 of the forward end position $B_2$ of the upper (fixed) forming plate 53 and a straight line X2 which is parallel to the ideal setting line X1 and passes through the intersection Q1 of the horizontal centerline $D_2$ and the forward end position $A_2$ of the pouched container.

Subsequently, an examination was conducted on the vertical displacement of the sucker units for smoothly setting the pouched container on the forming plates along the course parallel to the horizontal centerline $D_2$ of the mandrel. As a result, it was indicated that the displacement (a) of the upper sucker unit 74 should preferably be less than the displacement (b) of the lower sucker unit 78. The most efficient setting was achieved with 2a=b. The relationship 2a=b can be obtained if the ratio between the diameters of the pitch circles of the gears 79 and 80 is 2:1. This relation between a and b is formed only if the deviation angle of the upper forming plate 53 is narrower than that of the lower forming plate 55.

Figure 5:
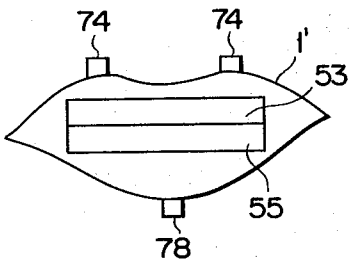
FIG. 5 is a front view showing a preferred arrangement of sucker units.

As shown in FIG. 5, the pouched container delivery apparatus is preferably constructed so that two upper sucker units 74 are arranged across the width of the pouched container 1', and that a single lower sucker unit 78 is located on the centerline. Thus, the pouched container 1' is prevented from abutting against the corner portions of the upper forming plate 53, and can smoothly be set on the forming plates 53 and 55 along the course parallel to the horizontal centerline of the mandrel. In this case, the lower sucker unit 78 is preferably greater in sucking force than each upper sucker unit 74.

The packaging mechanism according to the present invention will now be described in detail.

In this packaging mechanism, the containers are processes as they are fed by a conveyor system shown in FIGS. 6 to 9, securely held in position.

Figure 8:
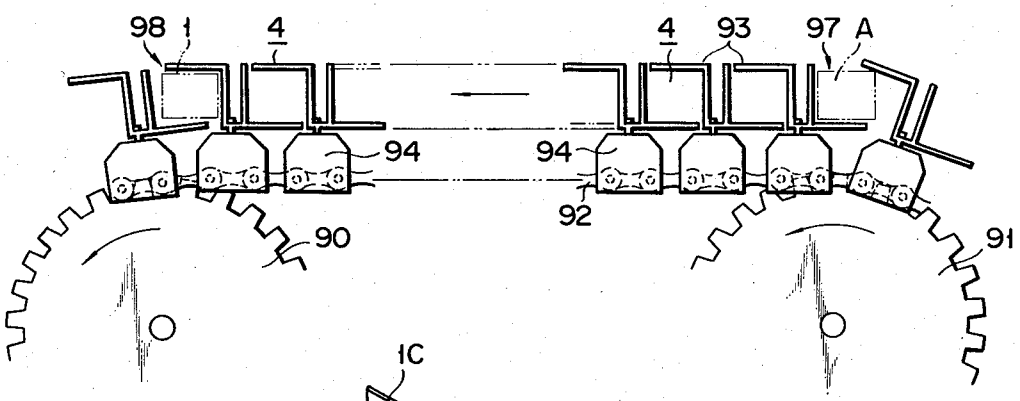
FIG. 8 is a plan view showing the way the carriers travel.
Figure 13:
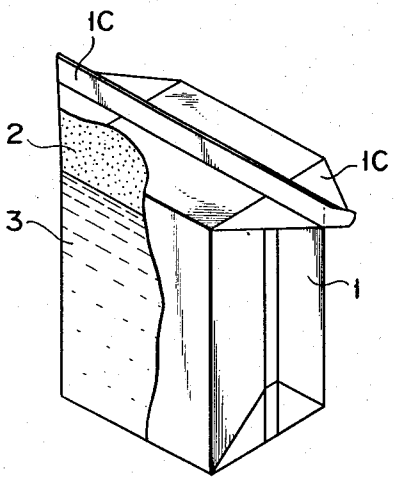
FIG. 13 is a perspective view showing the interior of a filled container.

The conveyor system is preferably constructed so that a plurality of blocks 93 arranged at regular intervals are attached to an endless chain 92 by means of brackets 94, as shown in FIG. 8. The endless chain 92 is passed around a pair of sprockets 90 and 91 as rotating members spaced from each other.

Figure 6:
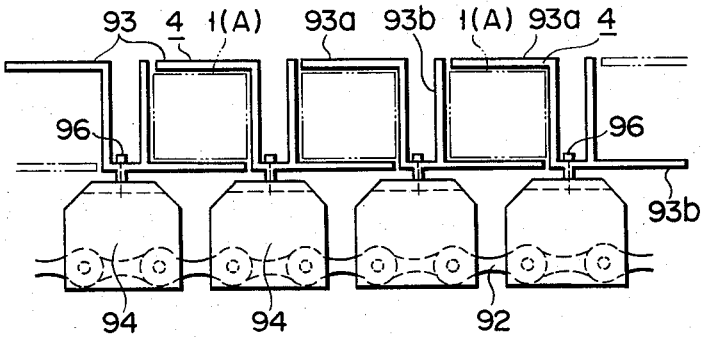
FIG. 6 is a plan view showing part of a conveyor system according to the one embodiment of the invention.
Figure 7:
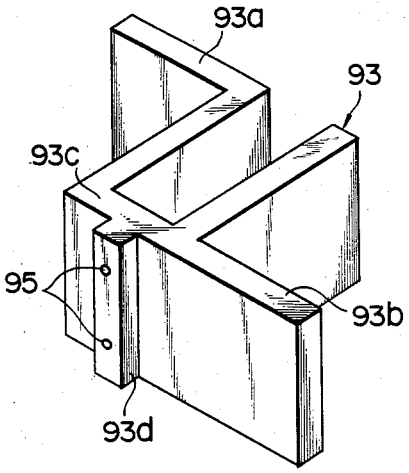
FIG. 7 is a perspective view of blocks constituting carriers.

As shown in FIG. 7, each block 93 is formed of an L-shaped portion 93*a* and an inverted-L-shaped portion 93*b* formed integrally therewith. A ridge 93*d* with a pair of bolt holes 95 are formed on the junction 93*c* of the two portions 93*a* and 93*b*. As shown in FIG. 6, each block 93 is attached to its corresponding bracket 94 by means of bolts 96.

The L-shaped portion 93*a* of each block 93 and the inverted-L-shaped portion 93*b* of each adjacent block 93 constitutes each of the square box-shaped carriers 4, which hold the containers 1 therein.

In the container transfer means 35 constructed in this manner, the blocks 93 are somewhat spaced and cannot form the square box-shaped carriers 4 at those curved portions of the chain 92 which are passed around the sprockets 90 and 91, as shown in FIG. 8. Therefore, the vacant containers 1 scraped off by the container scraping unit 33 of the container shaping/delivery section 25 are securely put into the carriers 4 with their open ends upward by setting a container receiving position 97 corresponding to the sprocket 90.

When the packaged product A reaches a container discharge position 98, it is securely discharged from the carrier 4 as an ejecting member 5 of the discharge unit 47 is lowered, as shown in FIG. 9.

The packaged product A discharged from the container 4 falls down sidelong as half of its bottom face abuts against the package throw-down unit 48 which is formed of a hanging tail end portion 99*a* of a guide rail 99 supporting the bottom surfaces of the containers 1. Thus, the packaged product A is transferred to the conveyor 49 of the delivery mechanism 38 to be carried out thereby.

In the aforementioned embodiment of the present invention, the endless chain is passed around the sprockets 90 and 91. The endless chain may, however, be replaced with a belt or wire passed around pulleys or other rotating members.

The conveyor system according to the above embodiment is constructed so that a plurality of blocks each integrally formed of L- and inverted-L-shaped portions are attached to the endless chain to form square carriers. Thus, the conveyor system is reduced in the number of components used therein and therefore in cost and space required, and can securely transfer containers without spoiling their sanitary conditions.

Figure 11:
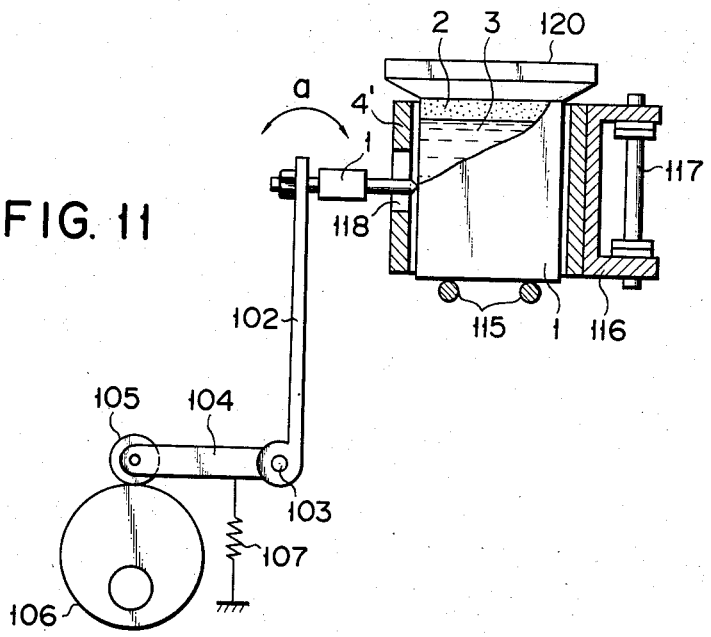
FIG. 11 is a side view of the deflating mechanism of FIG. 10.
Figure 12:
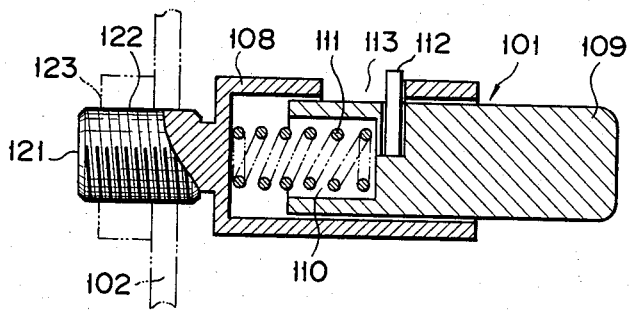
FIG. 12 is a partial sectional view of a push pin of the deflating mechanism of FIG. 11.

Referring now to FIGS. 10 to 12, the deflating mechanism of the packaging system will be described. In FIGS. 10 to 12, a box-shaped carrier 4' which is different in structure from that shown in FIGS. 6 to 8 is employed. In FIGS. 10 to 12, numeral 101 designates a push pin which is attached to the upper end portion of a first lever 102. The lower end portion of the first lever 102 is integrally supported by a support shaft 103, which also integrally supports one end portion of a second lever 104. The support shaft 103 is rockably supported by bearings (not shown). A roller 105 in rolling contact with a cam 106 is mounted on the other end portion of the second lever 104. The cam 106 is rotated by a drive motor (not shown), causing the second lever 104 to swing around the support shaft 103 to rock the first lever 102 in the directions indicated by arrow a. The second lever 104 is urged to rock counterclockwise by a spring 107.

As shown in FIG. 12, the push pin 101 is formed of an outer cylinder 108 and a pin body 109 movably fitted therein. A hollow 110 is formed in the rear end portion of the pin body 109, and a coil spring 111 is interposed between the hollow 110 and the inner bottom portion of the outer cylinder 108. A spring pin 112 protruding from the pin body 109 is inserted in a slide hole 113 in the outer cylinder 108, thereby preventing the pin body 109 from slipping out of the outer cylinder 108.

The push pin 101 is attached to the first lever 102 in the manner shown in FIG. 12. A Screw portion 121 is formed on the proximal end portion of the outer cylinder 108. The screw portion 121 is screwed in a tapped hole 122 in the first lever 102, and a nut 123 is fitted on the projected end of the screw portion 121 to fix the same.

In removing the residual air 2 in the container 1, the cam 106 is rotated to rock the first lever 102 in the direction of arrow a, thereby moving the push pin 101 forward, as shown in FIG. 11. As the push pin 101 advances in this manner, the pin body 109 of the push pin 101 gets into an opening 118 in the box-shaped carrier 4' and pushes a lateral face portion of the container 1. Thus, the air in the container 1 is discharged through its open end 120.

In the removal of the air, the impact of the pin body 109 on the container 1 is absorbed by the coil spring 111. Accordingly, even though the push pin 101 is quickly run against the container 1, the filling material 3 will never spring out of the container 1 through the open end A.

The depth of the push of the push pin 101 on the container 1 can suitably be adjusted by loosening the fixed nut 123 to change its position.

Figure 14:
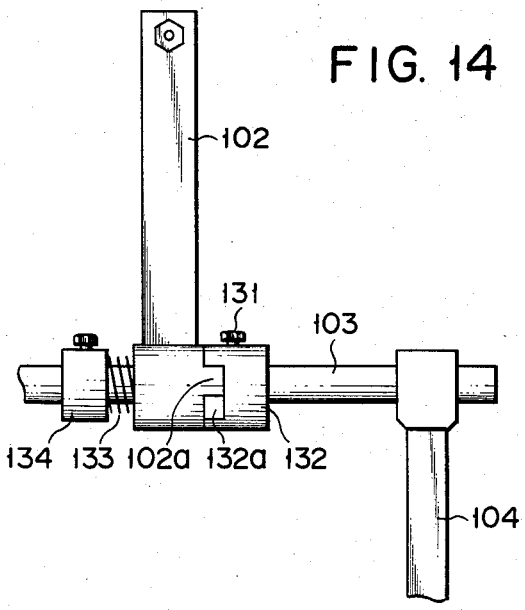
FIG. 14 is a side view of a deflating mechanism according to another embodiment of the invention.
Figure 15:
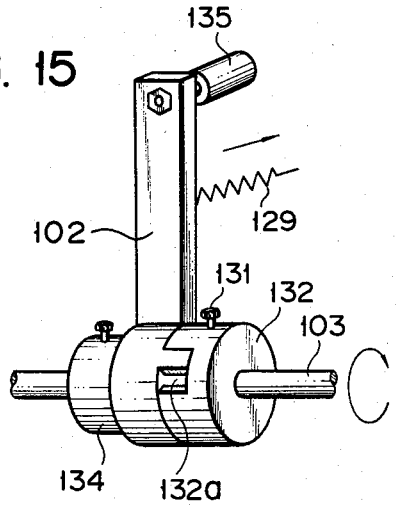
FIG. 15 is a perspective of the deflating mechanism of FIG. 14.

As shown in FIGS. 14 and 15, the push pin 101 may not be provided with any buffer means. In this case, the lower end portion of the first lever 102 is rockably supported by a support shaft 103, and is urged in the direction of the arrow of FIG. 15 by a spring 129. A projection 102*a* is formed on one end face of the lower end portion of the first lever 102, and engages a recess 132*a* of a collar 132 which is fixed to the support shaft 103 by means of a bolt 131. The width of the recess 132*a* is greater than that of the projection 102*a* so that the projection 102*a* can move inside the recess 132*a*. A retaining spring 133, which is fixed by a fixing member 134, presses the lower end portion of the first lever 102 against the collar 132.

When deflating the container 1, the cam 106 is rotated to rock the support shaft 103 through the medium of the second lever 104, so that the collar 132 is rocked in the direction of the arrow of FIG. 15. As the collar 132 rocks in this manner, the first lever 102 is rocked by the spring 129 to cause the push pin 135 to abut against the container 1, thereby removing the residual air 2 from the container 1. Meanwhile, the projection 102*a* at the lower end portion of the first lever 102 is movable in the recess 132*a* of the collar 132. Therefore, if the push pin 135 is subjected to the repulsive force of the container 1, the first lever 102 rocks in the opposite direction to absorb the impact.

Thus, also in this second embodiment, the filling material 3 can be prevented from springing out of the container 1 at the time of deflation.

Since the deflating mechanism according to the second embodiment is provided with a buffer member to absorb the impact produced when the push pin abuts against the container, the filling material will never spring out of the container despite the quick action of the push member for deflation. Thus, the sealing efficiency is improved, permitting high-speed operation of the system.

Figure 17:
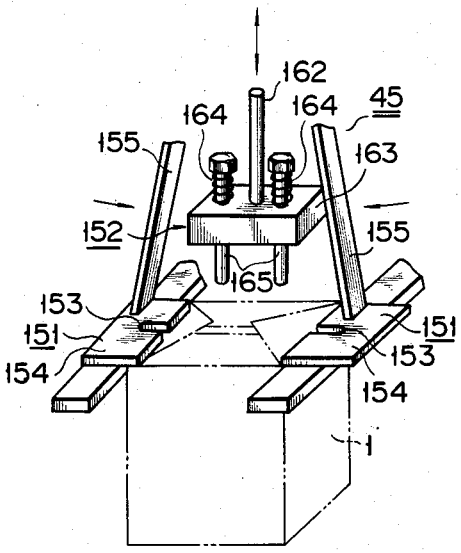
FIG. 17 is a perspective view showing the principal part of the lug folding/heat-sealing mechanism of FIG. 16.
Figure 16:
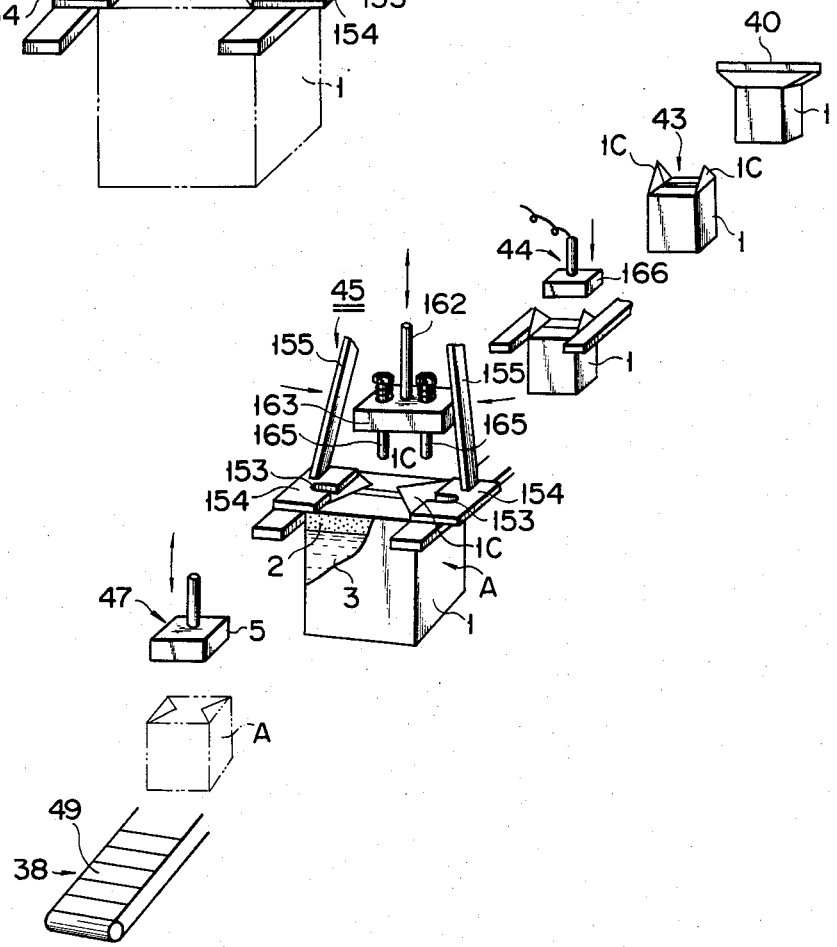
FIG. 16 is a perspective view for illustrating the arrangement of a lug folding/heat-sealing mechanism according to the one embodiment of the invention and several units located in the vicinity thereof.
Figure 18:
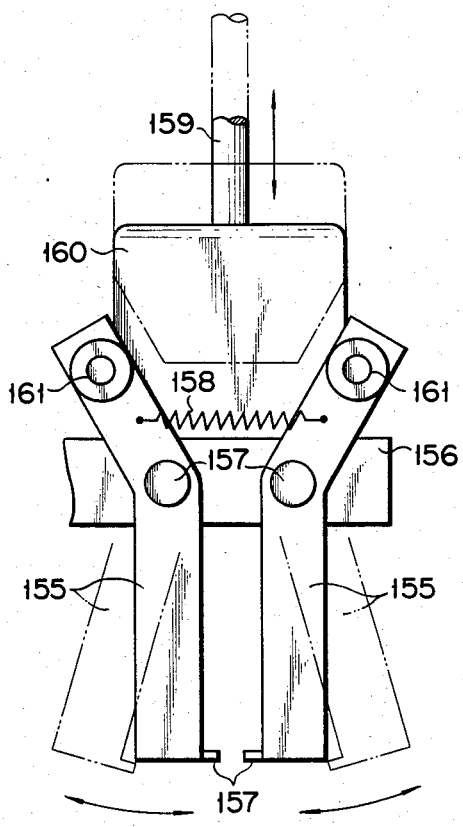
FIG. 18 is a front view of a tucking plate operating mechanism of the lug folding/heat-sealing mechanism of FIG. 16.

Referring now to FIGS. 16 to 18, the lug folding-/heat-sealing mechanism of the packaging system of the invention will be described in detail. As shown in FIG. 16, the lug folding/heat-sealing mechanism 45 directly follows the heating unit 44. As shown in FIG. 17, the lug folding/heat-sealing mechanism 45 includes a pair of first movable members 151 capable of reciprocating along the folding direction of the pair of lugs 1*c* to fold the lugs 1*c* on the top face of the container 1, and a second movable member 152 for pressing the lugs 1*c* folded by the first movable members 151 against the top face of the container 1.

Each of the first movable members 151 is formed of a tucking plate 154 having a notch 153, and is attached to the lower end portion of an operating lever 155. As shown in FIG. 18, the operating levers 155 are rockably mounted at the middle portion on a bracket 156 by means of their corresponding support shafts 157, and are normally urged by a spring 158 so that the tucking plates 154 are located outside. A pair of rollers 161 are mounted individually on the upper end portions of the operating levers 155, lying in the transfer path of a cam 160 which is mounted on an operating rod 159 of an air cylinder (not shown) or the like. When the cam 160 descends, the rollers 161 are pushed aside, and the operating levers 155 are moved inward or toward each other, as indicated by full line in FIG. 8.

As the cam 160 moves up and down, the operating levers 155 rocks around their corresponding support shafts 157 to tuck in the pair of triangular lugs 1*c* previously raised by the lug raising unit 43.

The second movable member 152 for pressing the folded lugs 1*c* against the top face of the container 1 includes a vertically movable block 163 attached to the lower end of an operating rod 162 of a cylinder (not shown), and a pair of push rods 165 capable of vertically moving against the block 163 and urged downward by coil springs 164.

Figure 19:
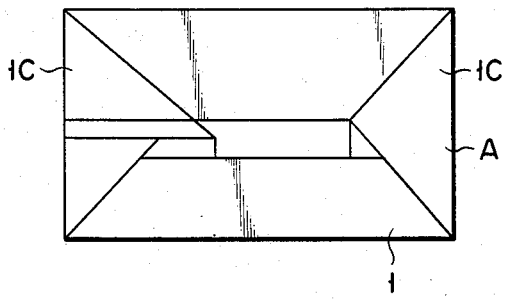
FIG. 19 is a plan view showing a finished state of an end face of the container obtained with use of the lug folding/heat-sealing mechanism of the invention.

As the tucking plates 154 move substantially in a straight line, the lugs 1*c* are securely tucked in from predetermined positions. When the lugs 1*c* are sandwiched between the tucking plates 154 and the top face of the container 1, the operating rod 162 of the cylinder is lowered so that the lower end faces of the push rods 165, urged by the springs 164, elastically press the forward end portions of the upper surfaces of the triangular lugs 1*c*, passing through the notches 153 in the tucking plates 154. Thus, the plastic surfaces of the lugs 1*c* previously heated and melted by a heater block 166 of the heating unit 44 are securely welded to the top face of the container 1 without deformation, as shown in FIG. 19.

Figure 20:
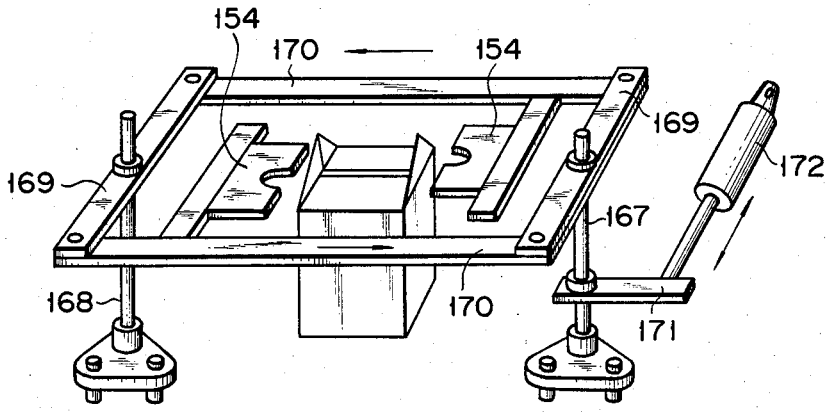
FIG. 20 is a perspective view of a tucking plate operating mechanism according to still another embodiment of the invention.

In the embodiment described above, the pair of tucking plates 154 constituting the first movable members 151 are attached to the operating levers 155 which swing together as the cam 160 moves up and down. Alternatively, however, the tucking plates 154 may be attached individually to parallel links 170 which are supported by a pair of connecting rods 169 rockable around support shafts 167 and 168, as shown in FIG. 20. In this arrangement, the tucking plates 154 may be moved toward and away from each other by rocking an arm 171 on the one support shaft 167 by means of a cylinder 172.

As described above, the lug folding/heat-sealing mechanism according to the present invention, despite its simple, inexpensive structure, can quickly securely fold and press lugs produced by sealing the open end portion of a container against the top face of the container without deformation.

According to the invention, moreover, a cooling mechanism is provided on the lower-course side of the lug folding/heat-sealing mechanism. Thus, even if the container is filled with a heated material, the residual air in the container will be prevented from being expanded by the heat of the filling material to bulge the top portion of the container. Accordingly, it is not difficult to transfer the filled and sealed container to another conveyor mechanism.

Figure 21:
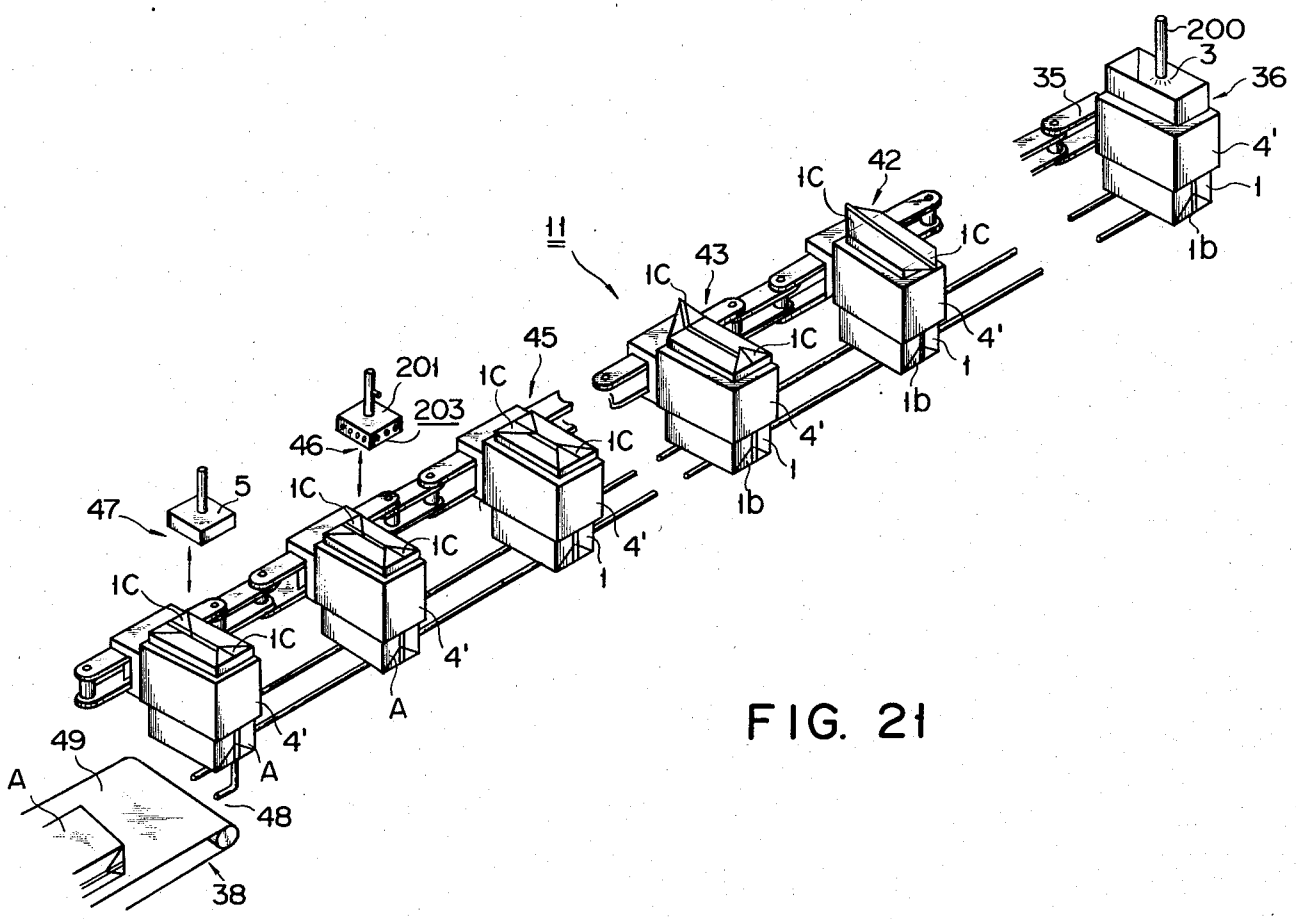
FIG. 21 is a perspective view for illustrating a cooling mechanism according to the one embodiment of the invention and several units surrounding the same.

FIG. 21 shows the cooling mechanism and several process units surrounding the same. In FIG. 21, numeral 200 designates a filling nozzle provided in the filling process unit 36. The filling nozzle 200 fills the container 1 with a fixed amount of heated filling material 3. A push member 201 in the bulge removing unit 46 securely presses the lugs 1*c* of the container 1 against the top face of the container 1 for adherence. The ejecting member 5 in the discharge unit 47 forces out the packaged product A from the box-shaped carrier 4' which is similar in structure to that shown in FIG. 10.

Figure 22:
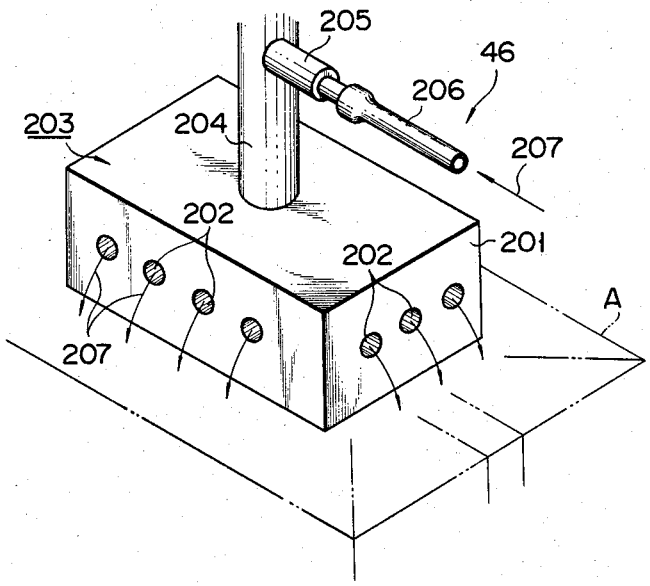
FIG. 22 is an enlarged perspective view showing the cooling mechanism of FIG. 21.
Figure 23:
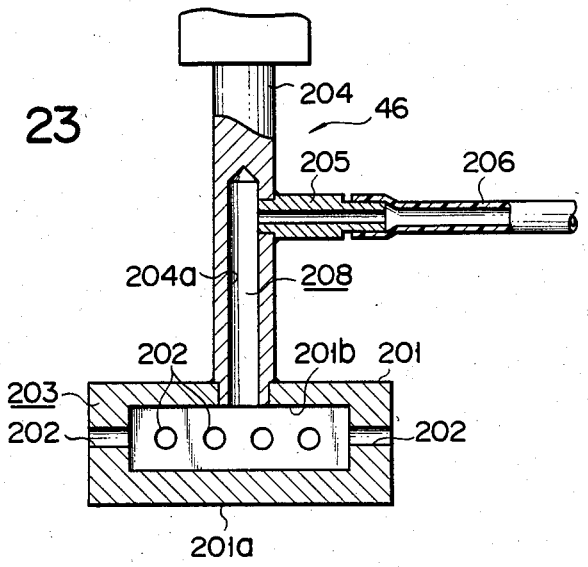
FIG. 23 is a sectional view of the cooling mechanism of FIG. 22.

As shown in FIGS. 22 and 23, the push member 201 has cooling water drain holes 202 as cooling water drain portions on its four side faces. The push member 201 presses the top face of the container 1 while sprinkling cooling water over the same. Thus, the push member 203 serves also as bulge removing means 203 for rapidly cooling the residual air 2 in the top inside space of the container 1, thereby removing a bulge at the top portion of the container 1 attributed to thermal expansion.

The push member 201 has a push surface 201*a* narrower than the top face of the container 1, and can be moved up and down by means of an operating rod 204. The cooling water drain holes 202 bored in the four side faces of the push member 201 are connected to a cooling water source (not shown) by means of a cooling water inlet passage 208 which is formed of a bore 204*a* extending inside the operating rod 204 along its axis, a coupling 205, a tube 206, etc.

As mentioned before, the air 2 remains in the container 1 or packaged product A which has just reached the lug folding/heat-sealing mechanism 45 and got through the packaging process. The residual air 2 may be expanded by the heat of the filling material 3 to form a bulge at the top portion of the container 1. Thus, it would be difficult to remove the bulged container 1 from the box-shaped carrier 4.

According to the present invention, however, cooling water 207 is sprinkled over the top face of the container 1 to rapidly cool the residual air 2 before the container 1 reaches the position where the packaged product A is removed from the box-shaped carrier 4.

As the residual air 2 contracts, the top portion of the container 1 is depressed in an instant to permit reliable removal from the carrier 4. Thus, it is possible to prevent lowering of quality of products due to containers damaged by awkward removal, leakage of the filling material (contents) 3 from the containers through tears in the bottom faces thereof, product loss, etc.

If the filling material 3 spatters or drips to stain the carriers 4 during the filling operation, the cooling water 207 can wash it away, ensuring very good sanitary conditions. Also, the cooling water 207 helps to smooth the removal of the container 1 from the carrier 4.

Good seal can be obtained since the fused portions of the triangular lugs 1*c* are rapidly cooled by the cooling water 207.

In the above embodiment, the bulge removing means 203 is formed of the push member 201 with the cooling water drain holes 202, whereby the triangular lugs 1*c* of the container 1 are pressed against the top face of the container 1 for adherence. Alternatively, however, the bulge removing means 203 may be provided independently or arranged in the position of the lug folding-/heat-sealing mechanism 45. Moreover, the cooling water drain portions are not limited to the simple through holes, and may be formed of grooves or nozzles. Naturally, the positions and number of the cooling water drain portions may be changed as required.

According to the present invention, as described above, it is possible securely to remove bulges of containers filled with heated filling material attributed to thermal expansion of residual air in the containers, and to take out packaged products from box-shaped carriers with high reliability.

What is claimed is:

1. In an automatic packaging system comprising a container fabricating mechanism for forming a tubular structure from laminated paper capable of heat sealing, means for marking folding guidelines for forming a rectangular-prism-shaped container, means for cutting an individual pouched container from the tubular structure, and a packaging mechanism for filling said pouched container with a filling material and sealing an open end of said pouched container; the improvement comprising:

said container fabricating mechanism comprising a rotating mandrel and at least one pair of radially arranged and pivotally mounted leading and trailing forming plates mounted on the mandrel and arranged to initially receive an unformed pouched container thereon in open condition and to release a formed container therefrom after a forming operation carried out during cyclic rotation of said mandrel and plates;

said leading and trailing forming plates each having a distal end portion for receiving a pouched container thereover and a proximal end portion pivotally mounted to the mandrel and including a guide element fixed relative to said proximal end;

first and second eccentric fixed annular guiding grooves arranged to cooperate respectively with said guide elements of said plates, said first and second annular guiding grooves each having a predetermined geometric configuration whereby movement of the leading and trailing plates and their guide elements relative to the grooves causes rotation of the plates relative to each other and to the mandrel about their pivots at predetermined locations around the rotary path of the mandrel and plates;

means for driving said leading and trailing plates and said mandrel about a rotary path with said guide elements engaging said annular grooves;

means for initially inserting a pouched container over said leading and trailing forming plates when the latter are disposed at a first location about the rotary path of the mandrel;

said grooves arranged relative to the mandrel so that, as said plates are driven relative thereto, the leading plate is rotated slightly towards the trailing plate at the location where a pouched container is initially received around said plates, and the trailing forming plate is pivoted away from said leading forming plate at a location immediately after where a pouched container is initially received around said forming plates; and so that, at the location where a pouched container is to be released from the mandrel, one of said leading or trailing forming plates is rotated slightly towards the other forming plate to freely release a pouched container thereon.

2. The automatic packaging system according to claim 1, wherein said mandrel includes a horizontal centerline; upper and lower suction means for holding a pouched container by suction on the top and bottom sides thereof prior to setting of same on said leading and trailing plates; means for moving the suction means individually upward and downward to extend the opening of a pouched container after engagement of the suction means with a pouched container, and means for moving the suction means in a direction parallel to said horizontal centerline to set the pouched container onto said forming plates.

3. The automatic packaging system according to claim 2, wherein the course along which a pouched container is set on the forming plates as the suction means move is coincident with a straight line extending parallel to a horizontal plane including said horizontal centerline of the mandrel and passing through the intersection of the forward end position of the leading forming plate and a straight line which (i) passes through the intersection of the forward end position of the pouched container and the horizontal centerline of the mandrel and (ii) has an inclination relative to horizontal corresponding to half the maximum pivoting angle of the trailing forming plate.

4. The automatic packaging system according to claim 2, wherein the upward displacement of the upper suction means of said pair of suction means is smaller than the lower displacement of the lower suction means.

5. The automatic packaging system according to claim 2, wherein said pair of suction means includes two upper suction units arranged in a transverse direction relative to a longitudinal centerline of a pouched container, and a lower suction unit disposed on a longitudinal centerline of a pouched container.

* * * * *